United States Patent [19]

Abatemarco

[11] Patent Number: 5,070,612

[45] Date of Patent: Dec. 10, 1991

[54] RAZOR BLADE ASSEMBLY

[76] Inventor: Michael Abatemarco, P.O. Box 17252, Fountain Hills, Ariz. 85268

[21] Appl. No.: 696,062

[22] Filed: May 6, 1991

[51] Int. Cl.[5] ..... B26B 21/00

[52] U.S. Cl. ..... 30/50; 30/80; 30/83

[58] Field of Search ..... 30/32, 47-50, 30/77, 79, 80, 83

[56] References Cited

U.S. PATENT DOCUMENTS

| | | | |
|---|---|---|---|
| 3,880,284 | 4/1975 | Pomfret . | |
| 4,026,016 | 5/1977 | Nissen . | |
| 4,063,354 | 12/1977 | Oldnoyd et al. | 30/47 |
| 4,168,571 | 9/1979 | Francis . | |
| 4,270,268 | 6/1981 | Jacobson . | |
| 4,403,412 | 9/1983 | Trotta | 30/83 |
| 4,492,024 | 1/1985 | Jacobson . | |
| 4,498,235 | 2/1985 | Jacobson . | |
| 4,551,916 | 11/1985 | Jacobson . | |
| 4,573,266 | 3/1986 | Jacobson . | |
| 4,586,255 | 5/1986 | Jacobson . | |
| 4,621,424 | 11/1986 | Jacobson . | |
| 4,641,429 | 2/1987 | Abatemarco . | |
| 4,742,909 | 5/1988 | Apprille . | |
| 4,934,840 | 7/1990 | Butka | 30/50 |

*Primary Examiner*—Douglas D. Watts
*Attorney, Agent, or Firm*—LaValle D. Ptak

[57] ABSTRACT

A razor blade assembly includes a base member with a guard member resiliently mounted on the front wall of the base member for movement toward and away from the base member. At least one blade is mounted on the base member and is resiliently biased toward the front wall by a spring. The blade is movable rearwardly against the action of the biasing spring in response to shaving forces, independently of the movement of the guard.

16 Claims, 2 Drawing Sheets

RAZOR BLADE ASSEMBLY

BACKGROUND

Safety razors having one or two blades permanently mounted in a disposal cartridge, or a disposable razor, have become highly popular. In most such cartridges or disposable razors which use a pair of tandomly mounted blades, the blades are separated by a spacer; and the cutting edge of the upper blade is spaced slightly rearwardly of the cutting edge of the lower blade. The position or spatial relationships between the blade or blades and the other rigid portions of the cartridge or disposable razor, are fixed. Typical constructions of this type of razor blade cartridge assembly are disclosed in the Dorion, Jr. U.S. Pat. Nos. 3,724,070 and 3,786,563; and Perry U.S. Pat. No. 3,768,162.

In the Dorion and Perry patents mentioned above, the handle of the razor and the other portions of the cartridge holding the blades, are secured together in a fixed relationship. The shaving efficiency of a safety razor using cartridges of the type disclosed in the Dorion and Perry patents, however, has been improved by mounting the blade assembly on a pivot on the razor handle; so that the assembly pivots during a shaving operation. Theoretically, this permits the blade assembly to follow the contours of the surface being shaved more closely than if the pivoting feature was not used. Typical systems of this type are disclosed in the Jacobson U.S. Pat. No. 4,621,424; Nissen U.S. Pat. No. 4,026,016; and Jacobson U.S. Pat. No. 4,551,916. These patents are typical of this type of assembly, which is also the subject matter of other prior art patents not mentioned here.

A different approach to providing increased shaving efficiency has been attempted by retaining the blade assembly as a whole, stationary, while at the same time, permitting movement of individual components, such as the guard and the blades, in response to forces encountered during shaving. Patents which disclose shaving units of this type for permitting independent movement of the blade or blades, and the guard, in response to forces which essentially are perpendicular to the plane of the blades, are Francis U.S. Pat. No. 4,168,571, in which the guard and the blades are mounted on a resilient pad, to permit movement perpendicular to the plane of the blades, as well as rocking of the blades; and Jacobson U.S. Pat. No. 4,270,268, in which the guard and two blades are independently spring-mounted within the cartridge for movement perpendicular to the plane of the blades. This same resilient mounting to produce the independent movement of the blades and guard, as disclosed in the Jacobson '268 patent, also is disclosed in the Jacobson U.S. Pat. Nos. 4,492,024; 4,498,235; and 4,573,266. In the '024 and '235 patents, the entire cartridge, additionally, is pivotally mounted on the handle in a manner similar to the pivotal mounting of the cartridge disclosed in Jacobson U.S. Pat. No. 4,621,424.

In the patents listed above, which permit independent bending movement of the blades in a plane perpendicular to the plane of the cutting edge of the blades, the space or vertical distance between the two blades (in a two-blade cartridge) is not maintained by a fixed spacer. This distance between the blades can vary in accordance with the different relative pressures applied to the blades during the shaving action. Consequently, the resiliency which is provided by the springs, to allow the blades to follow various contours in the surface of the skin being shaved, in some situations, interferes with the efficient operation of the second or rearward mounted blade at times when the spacing between the two blades is reduced. In such cases, the second blade overlies the first or leading blade by such a small amount that the two blades functionally "merge" and the "second cut" provided by the trailing or rearward blade is not effected. A similar problem exists between the guard and the lowermost blade where, in some circumstances, the vertical space between the guard and the leading or lowermost blade may be reduced to the point where efficient shaving is momentarily interrupted.

It is desirable to provide a razor blade assembly in the form of a cartridge in which blades are movable in response to forces encountered during a shaving operation, but which maintains the desired vertical spacing of the cartridge components throughout the shaving operation.

SUMMARY OF THE INVENTION

Accordingly, it is an object of this invention to provide an improved razor blade assembly.

It is another object of this invention to provide an improved razor blade assembly which facilitates close conformity of the blades of the assembly to a skin surface during a shaving operation.

It is an additional object of this invention to provide a razor blade assembly in the form of a cartridge, where the blade is resiliently mounted in the cartridge frame to permit limited displacement of the blade parallel to the plane of its major surface during a shaving operation.

It is a further object of this invention to provide an improved razor blade assembly in which the guard and at least one blade of the assembly are independently and resiliently mounted for movement within the assembly while maintaining the spatial relationships of the components of the assembly.

In accordance with a preferred embodiment of this invention, unit or frame, with first and second skin-engaging elements in the form of a guard and a cap, supported by the frame and located forwardly and rearwardly of the blade or blades mounted within the cartridge. The guard and a blade in the assembly are independently resiliently mounted to permit movement with respect to the frame in a direction substantially parallel to the plane of the blade, while maintaining the perpendicular spacing between the various parts during the shaving operation.

DETAILED DESCRIPTION

Figure 1:
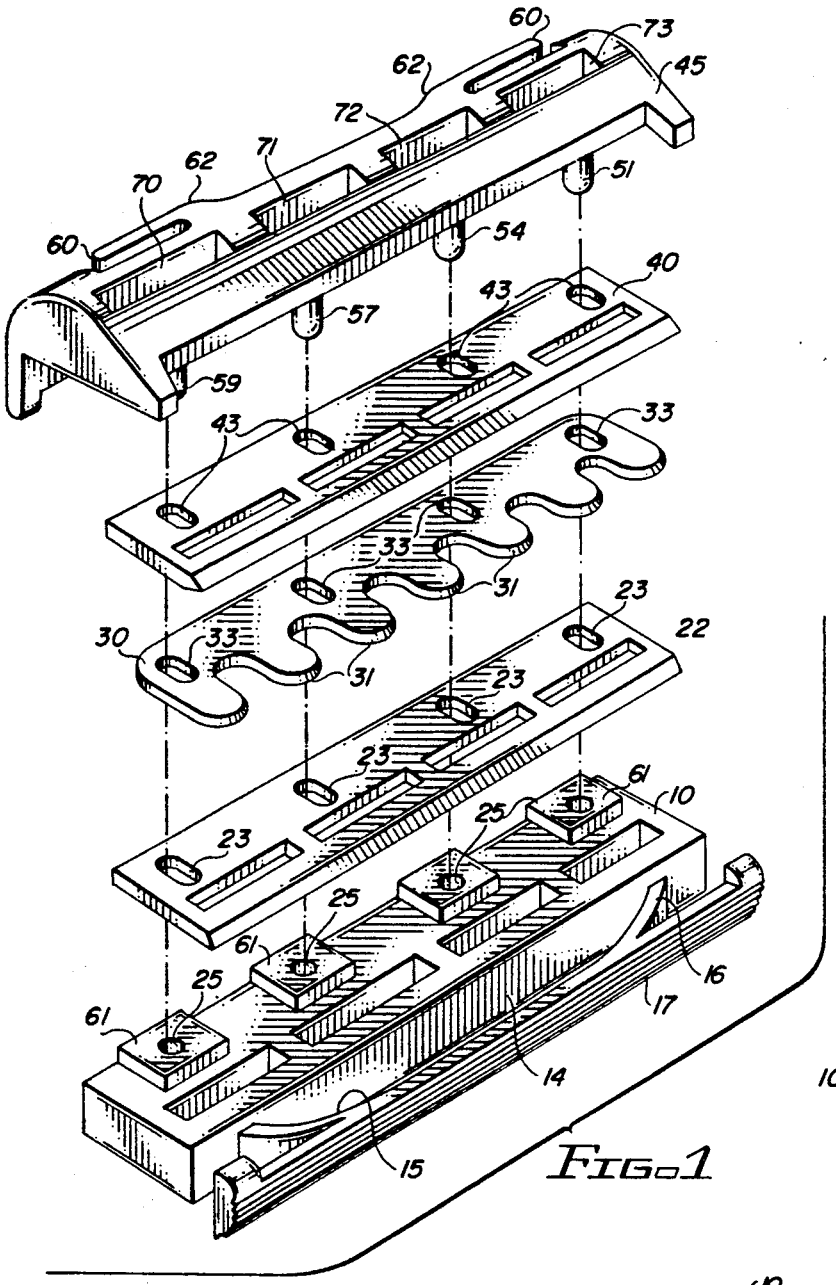
FIG. 1 is an exploded perspective view of a preferred embodiment of the invention.

In the various figures of the drawings, the same reference numbers are used for the same or similar components in all of the different figures. Reference first should be made to FIG. 1, which is an exploded view illustrating the various components of a cartridge-type razor blade assembly of a preferred embodiment of the invention.

Figure 2:
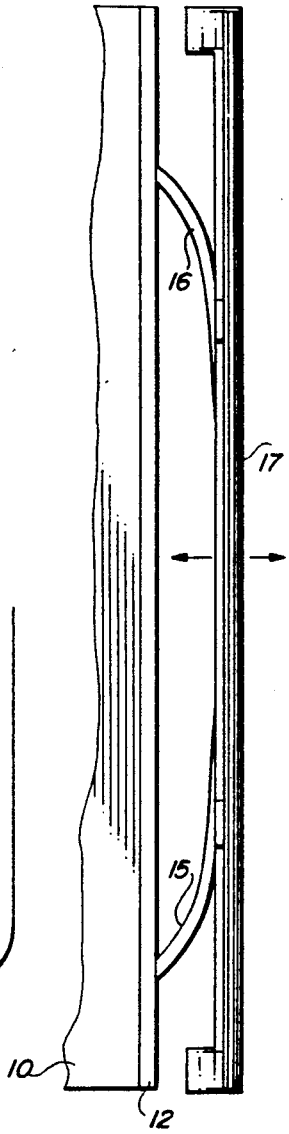
FIG. 2 is an enlarged top view of a portion of the embodiment shown in FIG. 1.

The assembly of FIG. 1 includes a base member 10 which forms the bottom of a disposable razor blade cartridge unit or the bottom of the blade-holding portion of a disposable razor. The front edge of the base 10 has a step portion 12 located in it, terminating in a front wall 14. A first or forward skin-engaging element in the form of a guard 17 is resiliently attached to this front wall 14 through a pair of curved, spring-like webs 15 and 16, as shown most clearly in the top view of FIG. 2. Also, as illustrated in FIGS. 1 and 2, the skin-engaging surface of the guard 17 has elongated ribs or serrations in it for ensuring good contact with the skin as the cartridge is used in a shaving operation. The base member 10, the guard 17 and the resilient spring webs 15 and 16 all preferably are formed as a part of a single, unitary plastic piece, with the wall thickness of the spring members 15 and 16 selected to provide the desired amount of resiliency for the guard 17.

As illustrated in FIG. 2, the guard 17 normally is biased outwardly to the position shown in FIG. 2, but it is capable of movement against the action of the spring members 15 and 16, toward and away from the front wall 14 of the base member 10 in the direction of the arrows shown in FIG. 2. Consequently, as the cartridge is moved over the surface of the skin to be shaved, pressure of the guard 17 bearing against the spring members 15 and 16 changes the relative distance between the guard 17 and the front wall 14 of the base 10 as the pressure of the cartridge is varied. This ensures that the guard 17 maintains close contact with the surface of the skin being shaved, and helps to stretch the skin.

Figure 3:
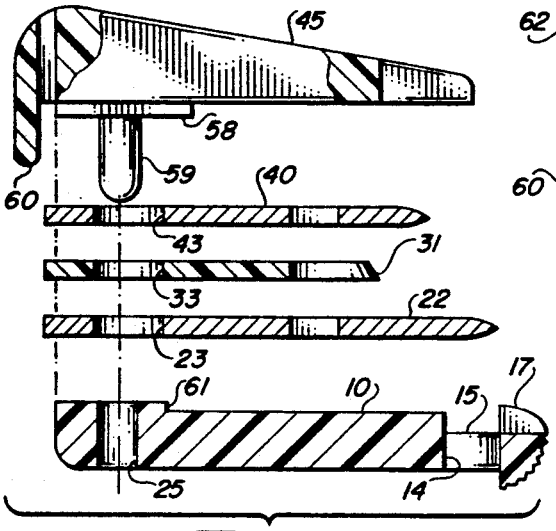
FIG. 3 is an exploded cross-sectional end view of the assembly shown in FIG. 1.
Figure 4:
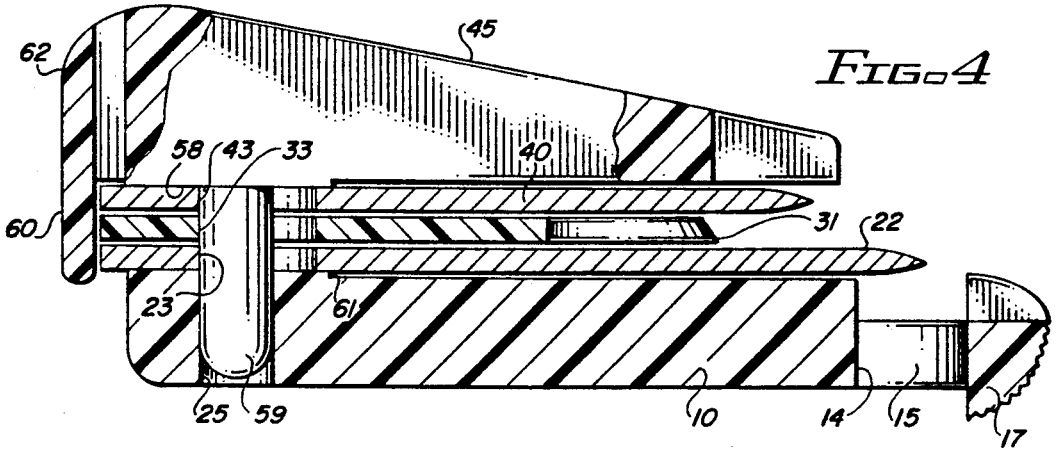
FIG. 4 is a cross sectional assembled end view of the assembly shown in FIG. 3 in one state of operation.
Figure 5:
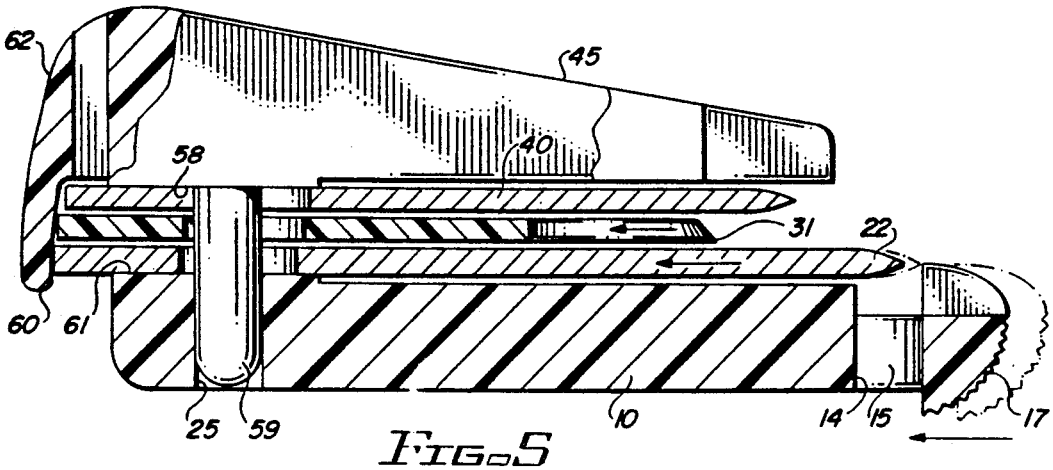
FIG. 5 is a cross-sectional assembled end view of the assembly shown in FIG. 3 in a second state of operation.

The remainder of the assembly shown in FIG. 1 includes a first and lower or leading single-edged planar razor blade 22, which is supported on rectangular islands 61 on the flat planar blade support surface of the base member 10, to extend outwardly over the step 12, as shown most clearly in the cross-sectional views of FIGS. 3, 4, and 5. Four elongated mounting holes 23 in the blade 22 are aligned with corresponding circular mounting holes 25 in the islands 61, located at the rear of the base member 10.

A comb-like spacer 30 then is placed on top of the blade 22, and a plurality of fingers 31 extend forwardly toward the cutting edge of the blade 22 and overlie the blade 22, again, as seen most clearly in FIGS. 3, 4, and 5. Four elongated mounting holes 33 are provided in the comb 30 to align with the holes 23 and 25 of the blade 22 and the base member 10, respectively.

Next in the assembly is a second or upper, rearwardly mounted blade 40 which is placed on top of the spacer 30. The blade 40 also has four elongated mounting holes 43 in it, and these holes are aligned with the holes 33, 23, and 25 described previously. This is to establish the location of the upper blade 40, slightly to the rear of the lower blade 22, as shown most clearly in FIGS. 3, 4, and 5. Also, the front or cutting edge of the blade 40 is located just forward of the front edges of the teeth 31 of the comb 30.

The cartridge assembly then is completed by placing a second skin-engaging member or cap member 45 over the top of the entire assembly. The cap member 45 has four cylindrical solid mounting posts 51, 54, 57, and 59, extending downwardly from it for insertion through the holes 43, 33, 23, and 25 of the other components of the cartridge to secure the unit together. As illustrated in FIGS. 4 and 5, the post 59 is secured by means of adhesive 55 into the hole 25 in the base 10. A similar attachment of the posts 51, 54, and 57 is made to firmly hold the entire assembly together.

The cap 45 also has two integrally formed, relatively thin, resilient leaf spring members 60 extending into the space between the top of the base 10 and the bottom of the cap 45. The spring members 60 are spaced downwardly from the rear of the cap 45 on spring members 60 are attached to the rear edge of the cap 45 by the arms 62 and extend freely down into the space between the cap 45 and base 10 in the manner shown in FIGS. 3 and 4. This is the relaxed or "stand-by" orientation of all of the parts of the cartridge assembly.

During a shaving operation, the cutting edges of the blades 22 and 40 encounter varying amounts of force in accordance with the contours of the surface of the skin being shaved and the pressure applied to the cartridge through the handle of the razor by the operator. This causes the lowermost or leading blade 22, in particular, to be pressed rearwardly (toward the left as shown in FIGS. 4 and 5) in the direction of the arrows of FIG. 5, against the resilient action of the springs 60 to cause the blade 22 to move from front to rear and back again in the plane of the blade during the shaving operation. This is the same motion which independently occurs for the guard 17, described previously. The spacer 31 and the upper blade 40 are permitted to move against the action of the springs 60. As shown in FIG. 5, the springs 60 have been moved to the position where the elongated slots 23, 33, and 43 no longer engage the rear end of the mounting post 58. Further pressure on the blade 22, in the direction of the arrow causes additional distortion of the spring members 60 to permit additional rearward movement of the blades 22 and 40 from the position shown in FIG. 5.

It is readily apparent from an examination of FIGS. 4 and 5, that the vertical spacing of the blades in a plane perpendicular to the planes of the blades 40 and 22 and to the guard 17, is maintained by the islands 58 and 61 throughout the operation of the cartridge. The spacer 31 ensures that the cutting edges of the blades 22 and 40 are maintained at the optimum desired spacing which is determined at the time of manufacture of the shaving cartridge. The blades 22 and 40 are not permitted to move toward and away from one another to increase and decrease the space between them, which is fixed by the thickness of the spacer 31. At all times during the shaving operation, irrespective of the back-and-forth or front-to-rear movement of the blades 22 and 40, with respect to one another and with respect to the base 10 of the cartridge, this ideal cutting spacing and angle of the blade always is maintained.

Figure 6:
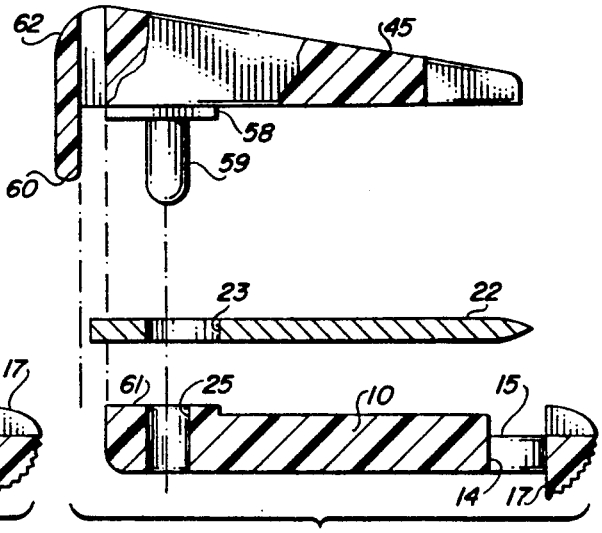
FIG. 6 is an exploded cross-sectional end view of an alternative embodiment similar to the embodiment of FIG. 1.

FIG. 6 illustrates a variation of the embodiment which has been described in conjunction with FIGS. 1 and 3 through 5. In FIG. 6, only a single blade 22 is employed. To permit the resilient front-to-rear movement of the blade 22, the cap 45 has the support islands 58 located on its undersurface around the pins 51, 54, 57, and 59. These islands 58 cause the blade to engage the spring member 59 at substantially the same relative position shown in FIGS. 4 and 5 for the blade 22 of the two-blade embodiment of the razor cartridge. In all other respects, the single blade cartridge of FIG. 6 operates in the same manner as the dual-blade cartridge illustrated in FIGS. 1 and 3 through 5.

Figure 7:
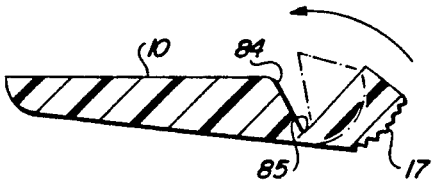
FIG. 7 is a cross-sectional view of an alternative to a portion of the structure of the embodiment shown in FIGS. 1 and 2.
Figure 8:
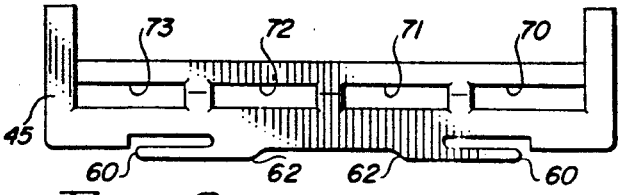
FIG. 8 is a top view of a portion of the embodiment of FIG. 1.
Figure 9:
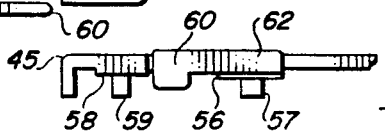
FIG. 9 is a rear view of the structure of FIG. 8.

FIG. 7 shows an alternative manner of providing resilient mounting of the guard 17. The base 10 of FIG. 7 is modified in the cross-sectional view shown in FIG. 7 to cause the front edge 84 to slope outwardly from the top surface of the base member 10 toward the lower edge of a guard 17, which is attached to the lower edge of the surface 84 through a resilient thin hinge member 85. As in the case of the embodiment of FIGS. 1 and 2, the guard 17, the base member 10 and the hinge 85 all may be formed of a single, unitary, plastic molded material. The thickness of the hinge 85 is selected to provide the desired amount of resiliency to permit a rocking motion of the guard 17, as illustrated in FIG. 7, to move the guard 17 from the solid line position to the dotted line position. The degree of motion which is illustrated in FIG. 7 has been exaggerated for the purpose of illustrating the functional operation of this variation of the preferred embodiment of the invention.

The foregoing description of the preferred embodiment of the invention should be considered illustrative and not as limiting. Different types of spring connections can be used, and different types of springs may be employed, if desired. Other variations and modifications will occur to those skilled in the art without departing from the true scope of the invention as defined in the appended claims.

I claim:

1. A razor blade assembly including in combination:
a base member having a substantially planer blade mounting surface and having a front wall;
resilient mounting means attached to said base member;
a guard member attached to said resilient mounting means for movement toward and away from the front wall of said base member;
at lease one blade means mounted on the blade mounting surface of said base member for limited movement thereon parallel to the plane of said blade mounting surface; and
resilient spring biasing means for biasing said blade means toward the front wall of said base member to a first predetermined position, said blade means movable in response to shaving forces rearwardly away from said first predetermined position.

2. The combination according to claim 1 wherein said resilient mounting means and said resilient spring biasing means comprise independent means.

3. The combination according to claim 2 further including means for maintaining the relative alignment of the front wall of said base member, the guard member and said blade means with one another.

4. The combination according to claim 3 wherein said means for maintaining alignment includes a cap with mounting posts extending downwardly therefrom, and wherein said base member and said blade means have corresponding apertures therein for receiving said mounting posts.

5. The combination according to claim 4 wherein said resilient mounting means is attached to the front wall of said base member and causes said guard member to move toward and away from said front wall in a plane parallel to the plane of said blade mounting surface.

6. The combination according to claim 5 wherein said base member, said resilient mounting means and said guard member are integrally formed with one another.

7. The combination according to claim 6 wherein said blade means comprises first and second blade means, each having a cutting edge, with a spacer between said first and second blade means, with the cutting edge of said second blade means spaced upwardly of the cutting edge of said first blade means by said spacer, and rearwardly of the cutting edge of said first blade means.

8. The combination according to claim 1 further including means for maintaining the relative alignment of the front wall of said base member, the guard member and said blade means with one another.

9. The combination according to claim 8 wherein said means for maintaining alignment includes a cap with mounting posts extending downwardly therefrom, and wherein said base member and said blade means have corresponding apertures therein for receiving said mounting posts.

10. A razor blade assembly including in combination:
a base member having a substantially planer blade mounting surface and having a front wall;
at least one blade means mounted on the blade mounting surface of said base member for limited movement thereon, parallel to the plane of said blade mounting surface;
a cap with mounting posts extending downwardly therefrom, and wherein said base member and said blade means have corresponding apertures therein for receiving said mounting posts; and
resilient spring biasing means integrally formed with said cap and extending downwardly from the rear thereof toward said base member for biasing said blade means toward the front wall of said base member to a first predetermined position, said blade means movable in response to shaving forces rearwardly away from said first predetermined position.

11. The combination according to claim 10 wherein said blade means comprises first and second blade means, each having a cutting edge, with a spacer between said first and second blade means, with the cutting edge of said second blade means spaced upwardly of the cutting edge of said first blade means by said spacer, and rearwardly of the cutting edge of said first blade means.

12. The combination according to claim 10 further including a guard member attached to said base member.

13. The combination according to claim 10 wherein the apertures in said blade means are elongated to permit said limited movement with respect to said mounting posts.

14. The combination according to claim 10 wherein said blade means has a rear edge and a front cutting edge and said spring biasing means engages the rear edge of said blade means to resiliently bias said blade means to said first predetermined position.

15. The combination according to claim 14 further including a guard member attached to said base member.

16. The combination according to claim 15 wherein the apertures in said blade means are elongated to permit said limited movement with respect to said mounting posts.

* * * * *